US011196137B2

(12) United States Patent
Park et al.

(10) Patent No.: US 11,196,137 B2
(45) Date of Patent: Dec. 7, 2021

(54) RADIO FREQUENCY FILTER

(71) Applicant: KMW INC., Hwaseong-si (KR)

(72) Inventors: Sung Bae Park, Hwaseong-si (KR); Joung-Hoe Kim, Hwaseong-si (KR); Nam-Shin Park, Hwaseong-si (KR)

(73) Assignee: KMW INC., Hwaseong-si (KR)

( * ) Notice: Subject to any disclaimer, the term of this patent is extended or adjusted under 35 U.S.C. 154(b) by 0 days.

(21) Appl. No.: 16/929,141

(22) Filed: Jul. 15, 2020

(65) Prior Publication Data

US 2020/0350651 A1 Nov. 5, 2020

Related U.S. Application Data

(63) Continuation of application No. PCT/KR2018/016702, filed on Dec. 27, 2018.

(30) Foreign Application Priority Data

Jan. 31, 2018 (KR) ..... 10-2018-0012485

(51) Int. Cl.
*H01P 1/208* (2006.01)

(52) U.S. Cl.
CPC ..... *H01P 1/208* (2013.01); *H01P 1/2084* (2013.01)

(58) Field of Classification Search
CPC ..... H01P 1/208; H01P 1/2084
USPC ..... 333/208, 209
See application file for complete search history.

(56) References Cited

U.S. PATENT DOCUMENTS

| | | | | |
|---|---|---|---|---|
| 6,342,825 | B2 | 1/2002 | Hershtig | |
| 6,836,198 | B2 | 12/2004 | Engst | |
| 9,105,955 | B2 * | 8/2015 | Puoskari | H01P 7/04 |
| 2003/0117241 | A1 | 6/2003 | Engst | |

(Continued)

FOREIGN PATENT DOCUMENTS

| | | | |
|---|---|---|---|
| CN | 201927688 | U | 8/2011 |
| CN | 202839921 | U | 3/2013 |
| CN | 105846020 | A | 8/2016 |

(Continued)

OTHER PUBLICATIONS

Office action dated Mar. 18, 2021 from Chinese Patent Office for Chinese Application No. 201910071238.6 and its English translation.

(Continued)

*Primary Examiner* — Rakesh B Patel

(57) ABSTRACT

Disclosed herein is a radio frequency filter having a notch structure. The radio frequency filter includes a hollow housing having a plurality of partition walls defining a plurality of cavities and an open surface formed on one side, a cover configured to shield the open surface of the housing, a plurality of resonance elements positioned in the cavities of the housing, a coupling substrate arranged to cross a partition wall between at least two of the plurality of resonance elements, and a tuning screw inserted into the housing through the cover. The partition wall crossed by the coupling substrate includes a support window formed to have a first depth from the open surface, the coupling substrate being arranged through the support window, and a tuning window formed to have a second depth greater than the first depth from the open surface, the tuning screw being inserted into the tuning window.

10 Claims, 7 Drawing Sheets

(56) References Cited

U.S. PATENT DOCUMENTS

| | | | |
|---|---|---|---|
| 2007/0139142 | A1 | 6/2007 | Li et al. |
| 2014/0210573 | A1 | 7/2014 | Hung |

FOREIGN PATENT DOCUMENTS

| | | | |
|---|---|---|---|
| CN | 107123844 | A | 9/2017 |
| JP | 2003-174303 | A | 6/2003 |
| JP | 2016-201801 | A | 12/2016 |
| KR | 10-2004-0100084 | A | 12/2004 |
| KR | 10-2014-0026235 | A | 3/2014 |
| KR | 10-2015-0118768 | A | 10/2015 |
| KR | 20170002133 | A | 1/2017 |
| KR | 10-2017-0043826 | A | 4/2017 |
| KR | 10-2017-0062804 | A | 6/2017 |
| KR | 10-2017-0111269 | A | 10/2017 |

OTHER PUBLICATIONS

International Search Report for PCT/KR2018/016702 dated Mar. 28, 2019 and its English translation.
Office action dated Jun. 1, 2021 from Japanese Patent Office for Japanese Application No. 2020-538959 and its English translation.
Extended European Search Report dated Oct. 5, 2021 for European Application No. 18903988.6.

* cited by examiner

RADIO FREQUENCY FILTER

CROSS-REFERENCE TO RELATED APPLICATION

This application is a continuation of International Application No. PCT/KR2018/016702, filed on Dec. 27, 2018, which claims priority, under 35 U.S.C § 119(a), to Korean Patent Application No. 10-2018-0012485, filed on Jan. 31, 2018 in Korea, the entire contents of which are incorporated herein by reference.

TECHNICAL FIELD

The present disclosure relates to a radio frequency filter, and more particularly, to a cavity type radio frequency filter.

BACKGROUND ART

A cavity-type radio frequency filter (hereinafter referred to simply as "filter") generally has a metallic housing provided therein with multiple accommodation spaces or cavities having a shape such as a quadrangular parallelepiped, in each of which, for example, a dielectric resonance (DR) element or a resonance element composed of a metallic resonance rod is provided to generate high-frequency resonance. In some cases, it may have a structure that generates resonance in the shape of the cavity without a DR element. The cavity structure of such a cavity-type radio frequency filter is generally provided, at an upper portion thereof, with a cover for shielding the open surface of the corresponding cavity. As a tuning structure for tuning the filtering characteristics of the radio frequency filter, multiple tuning screws and nuts for fixing the tuning screws may be installed in the cover. As an exemplary cavity-type radio frequency filter disclosed in Korean Patent Application Publication No. 10-2004-100084 (entitled "Radio Frequency Filter"; Publication Date: Dec. 2, 2004; Inventors: PARK Jonggyu et al.) filed by the present applicant.

Such cavity-type radio frequency filters are used for processing of transmitted or receive radio signals in a wireless communication system, particularly used for a base station or a relay in a mobile communication system.

Recently, with an increase in data processing capacity required in a mobile communication system, a method of installing a large number of small (micro) base stations has been proposed in order to address a surge in wireless data traffic. In addition, steady technology development is being progressed for weight reduction and miniaturization of wireless signal processing equipment installed in a base station. Particularly, as the cavity-type filter requires a relatively large size due to the characteristics of the structure having cavities, miniaturization and weight reduction of the cavity-type filter are emerging as a major consideration.

Important characteristics of the radio frequency filter include insertion loss and a skirt characteristic. The insertion loss refers to power that is lost while a signal passes through the filter. The skirt characteristic refers to steepness of the passband and stopband of the filter. The insertion loss and the skirt characteristic have a tradeoff relationship with each other according to the number of stages (order) of the filter. As the number of stages of the filter increases, the skirt characteristic is improved, but the insertion loss is deteriorated.

A method of forming a notch (an attenuation pole) is mainly used to improve the skirt characteristic of the filter without increasing the number of stages of the filter. The most common method of forming a notch is cross coupling.

The cross-coupling notch structure is typically provided with a metal workpiece such as, for example, a metal rod that is positioned between resonance elements in two cavities that are not continuous in a circuit to form capacitance coupling between the resonance elements through a partition wall between the cavities. The metal rod is arranged through an inner wall that separates the two cavities. Here, in order to electrically isolate the metal rod from the inner wall, the metal rod is wrapped with a support made of a dielectric material (not shown), such as Teflon, and then coupled to the inner wall. Here, a portion of the inner wall through which the metal rod is installed on the inner wall may be formed in a through hole structure. However, since it is not easy to form a through hole in the inner wall from the perspective of the working process, it is common to cut a part of the upper end of the inner wall and install the metal rod wrapped with the support in the cut portion. The support not only serves to insulate the metal rod, but also has a shape to engage with the shape of the cut portion so as to be fixed at the installation position to fixedly support the metal rod.

An example of a technique for forming a notch using the cross-coupling method is disclosed in U.S. Pat. No. 6,342,825 of K & L Microwave Co., (entitled "BANDPASS FILTER HAVING TRI-SECTION"; Inventor: Rafi Hershtig; Date of patent: Jan. 29, 2002), or U.S. Pat. No. 6,836,198 of RADIO FREQUENCY SYSTEMS (entitled "ADJUSTABLE CAPACITIVE COUPLING STRUCTURE"; Inventor: Bill Engst; Date of patent: Dec. 28, 2004).

A notch structure using such a cross-coupling method may be applied almost essentially even to implementation of a small (micro) cavity-type filter applied to a small (micro) base station. Due to the limitations of space and size that the small filter has, the distance between the resonance elements and the metal rod should be designed to be very short to obtain a desired degree of coupling in the notch structure using the cross-coupling method. However, it is very difficult to accurately implement the distance between the resonance elements and the metal rod corresponding to a required degree of coupling with a machining tolerance of, for example, about +/−0.03 to 0.05 mm, which is common used in metal processing, and accordingly the degree of cross coupling greatly varies between products.

Accordingly, in the cross-coupling notch structure applied to a small (micro) filter, implementing a designed structure into a real product requires a very high machining precision in manufacturing and installing a metal rod (and resonance elements) of the cross-coupling structure. For example, the machining tolerance of about 0.01 mm or less may be required for the gap between the metal rod and the resonance elements. However, when a very precise machining tolerance is required, the difficulty in the machining operation is increased and the machining time is increased, which result in higher machining costs and a lower production yield, and thus makes mass production difficult.

DISCLOSURE

Technical Problem

Therefore, it is one object of the present disclosure to provide a radio frequency filter that is easily fine-tuned despite a machining tolerance.

It is another object of the present disclosure to provide a cavity-type radio frequency filter having a cross-coupling notch structure that is more compact and lightweight.

It is another object of the present disclosure to provide a cavity-type radio frequency filter having a cross-coupling notch structure that is simpler and easier to manufacture, and has a stable structure, thereby providing stable notch characteristics.

It will be appreciated by persons skilled in the art that the objects that can be achieved with the present disclosure are not limited to what has been particularly described hereinabove and other objects that can be achieved with the present disclosure will be more clearly understood from the following detailed description.

Technical Solution

In accordance with one aspect of the present disclosure, provided is a radio frequency filter including a hollow housing having a plurality of partition walls defining a plurality of cavities and an open surface formed on one side; a cover configured to shield the open surface of the housing; a plurality of resonance elements positioned in the cavities of the housing; a coupling substrate arranged to cross a partition wall between at least two of the plurality of resonance elements; and a tuning screw inserted into the housing through the cover.

The partition wall crossed by the coupling substrate may include a support window formed to have a first depth from the open surface, the coupling substrate being arranged through the support window; and a tuning window formed to have a second depth greater than the first depth from the open surface, the tuning screw being inserted into the tuning window.

The support window and the tuning window may form a "ㄱ"-shaped window structure on the partition wall crossed by the coupling substrate.

The filter may be configured such that when a depth of insertion of the tuning screw into the tuning window increases, inductance between at least two resonance elements of the plurality of resonance elements increases.

The coupling substrate may include a base substrate and a conductive pattern layer formed on one surface of the base substrate, wherein the conductive pattern layer may include a plurality of capacitive pads disposed adjacent to the at least two resonance elements; and a connecting line portion arranged to connect the capacitive pads.

At least one of the base substrate and the conductive pattern layer may have a dumbbell shape.

The base substrate may have a rectangular shape, wherein the base substrate may further include a screw through hole allowing the tuning screw to pass therethrough.

The coupling substrate may be vertically disposed in a height direction of the housing, wherein the capacitive pads may be disposed side by side adjacent to resonance rods of the two resonance elements, An opposite surface of the base substrate may be bonded to one side wall of the partition wall, the one side wall defining one side of the support window.

The support window may be formed by removing a portion of the partition wall crossed by the coupling substrate, wherein the coupling substrate may be disposed on a support step of a partition wall defining a lower portion of the support window.

The coupling substrate may be bonded to the support step by soldering.

The radio frequency filter may further include a seating groove formed on the support step and extending parallel to a straight line connecting the at least two resonance elements, wherein at least a portion of the coupling substrate may be disposed in the seating groove.

Other details of the present disclosure are included in the detailed description and the drawings.

MODE FOR INVENTION

Figure 1:
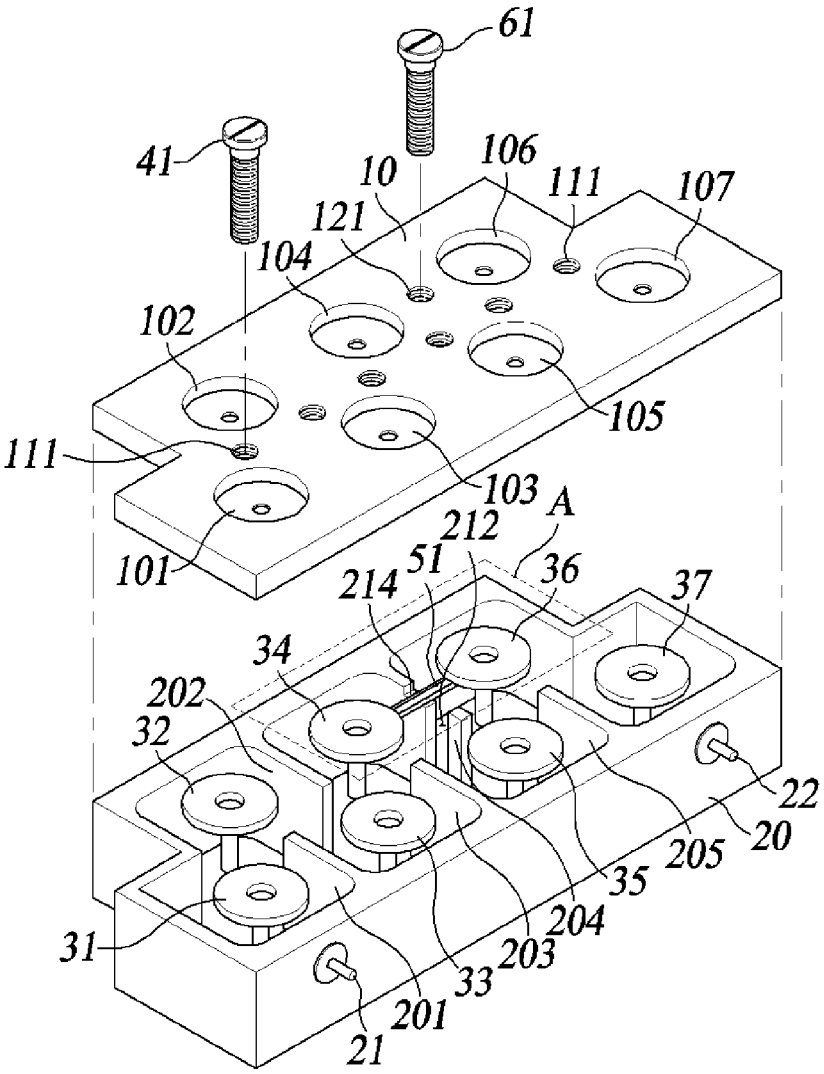
FIG. 1 is an exploded perspective view of a cavity-type radio frequency filter according to an embodiment of the present disclosure.

Hereinafter, some embodiments of the present disclosure will be described in detail with reference to the accompanying drawings. It should be noted that, in adding reference numerals to the constituent elements in the respective drawings, like reference numerals designate like elements, although the elements are shown in different drawings. Further, in the following description of the present disclosure, a detailed description of related known elements and functions incorporated herein may be omitted to avoid obscuring the subject matter of the present disclosure.

Hereinafter, embodiments according to the present disclosure will be described in detail with reference to the accompanying drawings.

FIG. 1 is an exploded perspective view of a cavity-type radio frequency filter according to an embodiment of the present disclosure.

Referring to FIG. 1, a cavity-type radio frequency filter according to an embodiment of the present disclosure includes a hollow housing 20, a cover 10, a plurality of resonance elements 31 to 37, a coupling substrate 51, and a tuning screw 61.

In one embodiment, the cavity-type radio frequency filter is provided with an enclosure formed hollow inside and having multiple cavities (for example, 7 cavities as in FIG. 1) blocked from the outside. In one embodiment, the enclosure includes a housing 20 provided with, for example, seven cavities and having one side (e.g., an upper side) open, and a cover 10 arranged to shield the open surface of the housing 20. The cover 10 and the housing 20 may be joined to each other by laser welding or soldering, or may be coupled to each other by screw coupling using a fixing screw (not shown).

The housing 20 and the cover 10 may be made of a metallic material such as, for example, aluminum or an alloy thereof, and may be plated with silver or copper on at least a surface forming a cavity to improve electrical properties. The resonance elements may also be made of a material such as aluminum (alloy) or iron (alloy), and may be plated with silver or copper.

In the embodiment shown in FIG. 1, for example, seven cavity structures are illustrated as being connected in multiple stages in the housing 20. That is, seven cavity structures may be sequentially connected. Each cavity of the housing 20 is provided with a resonance element 31, 32, 33, 34, 35, 36, 37 in the center thereof. In addition, in order to ensure that the respective cavity structures in the housing 20 have sequential coupling to each other, a coupling window, which is a connection passage structure, is formed between the cavity structures sequentially connected to each other. The coupling window may be formed by removing a predetermined portion of a predetermined size from a portion corresponding to partition walls 201, 202, 203, 204, and 205 of the cavity structures.

In the structure shown in FIG. 1, at least a part of the resonance elements 31, 32, 33, 34, 34, 35, 36, 37 may have the same structure. However, in the embodiment illustrated in FIG. 1, for convenience of description, all the resonance elements are illustrated as having the same structure. For example, each of the first to seventh resonance elements 31 to 37 may include a flat plate portion having a circular disc shape, and a support for fixing and supporting the flat plate portion. Each support is fixedly installed on the inner bottom surface of the corresponding cavity, that is, the housing 20. More specifically, the flat plate portion and the support in each of the resonance elements 31 to 37 may have various structures according to the design conditions of the corresponding filter, and resonance elements of different detailed structures may be configured to be mixed.

First to seventh recessed structures 101, 102, 103, 104, 105, 106, and 107 for frequency tuning may be formed in the cover 10 to correspond to the resonance elements 31 to 37 of the respective cavity structures. In addition, multiple coupling tuning screw holes 111 may be formed in the cover 10 at positions corresponding to the coupling windows which are connection passage structures of the cavity structures in the housing 20. Coupling tuning screws 41 for coupling tuning are inserted into the coupling tuning screw holes 111 at an appropriate depth to perform a coupling tuning operation. Here, the coupling tuning screws 41 may be additionally fixed using a separate adhesive such as epoxy resin.

In addition, an input terminal 21 and an output terminal 22 of the radio frequency filter may be installed through a through hole or the like that may be formed on one side of the housing 20. In the example of FIG. 1, it is illustrated that the input terminal 21 is coupled to the first resonance element 31, and the output terminal 22 is connected to the seventh resonance element 37. For example, an extension line (not shown) of the input terminal 21 and the support of the first resonance element 31 may be coupled in a manner of direct connection, or may be connected in a non-contact coupling manner.

In the configuration above, the structure of the cover 10 may have a structure similar to that applied to a radio frequency filter having a conventional cavity structure. For example, the cover 10 may have a structure similar to the structure disclosed in Korean Patent Application Publication No. 10-2014-0026235 (entitled "RADIO FREQUENCY FILTER WITH CAVITY STRUCTURE"; Publication Date: Mar. 5, 2014; Inventor: PARK Namshin et al.) filed by the present applicant. Korean Patent Application Publication No. 10-2014-0026235 proposes a simplified filter structure capable of frequency tuning without employing a more general fastening structure of a tuning screw and a fixing nut. The cover 10 according to embodiments of the present disclosure has one or more recessed structures 102 to 107 formed at positions corresponding to the resonance elements 31 to 37. Multiple dot peen structures are formed in the recessed structures 102 to 107 by marking or pressing by a marking pin of external marking equipment to enable frequency tuning.

In some other embodiments of the present disclosure, a more generalized frequency tuning method may be applied to the cover 10, and thus a frequency tuning screw and a fixing nut may be provided without forming a structure such as the recessed structure 12. However, the structure provided with the frequency tuning screw and the fixing nut may be more complex and may be difficult to miniaturize.

Regarding the above-described structures, the cavity structures formed in the housing 20 and the cover 10 in the radio frequency filter according to an embodiment of the present disclosure, and the structures of the resonance elements 31 to 37 inside the cavities are similar to a conventional structure except that the structure may be implemented in a smaller size than the conventional structure. However, the cross-coupling structure capable of fine tuning according to embodiments of the present disclosure may have an improved structure compared to the conventional structure.

In one embodiment, the coupling substrate 51 is arranged to cross the partition wall 204 between at least two resonance elements. In the embodiment, it is illustrated that the coupling substrate 51 is arranged to cross the partition wall 204 between the fourth resonance element 34 and the sixth resonance element 36.

Here, the coupling substrate 51 is installed on the partition wall 204 that separates the cavity of the fourth resonance element 34 from the cavity of the sixth resonance element 36, and is provided with a window structure formed by removing an appropriate portion such that the tuning screw 61 may be disposed therein.

In addition, the cover 10 is provided with a notch tuning through hole 121 at a position corresponding to the coupling substrate 51. The tuning screw 61 is coupled to the notch tuning through hole to tune the notch characteristic. The tuning screw 61 set to an appropriate length for notching tuning is inserted into the notch tuning through hole 121 to tune the notch characteristic in connection with the coupling substrate 51. Here, the tuning screw 61 may be formed in a screw shape as a whole, and may have a structure coupled to the notching tuning through hole 121 in a screw coupling manner. The tuning screw 61 may be formed of a conductive metal material such as aluminum (alloy) or brass (alloy), and plated with silver.

Figure 2:
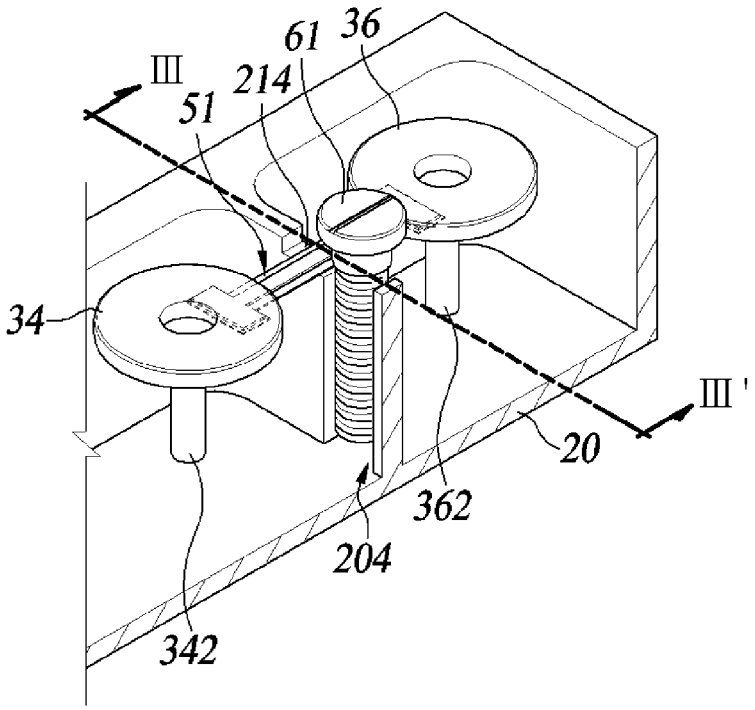
FIG. 2 is a cross-sectional view of portion A of the radio frequency filter, indicated by a dotted rectangle in FIG. 1.
Figure 3:
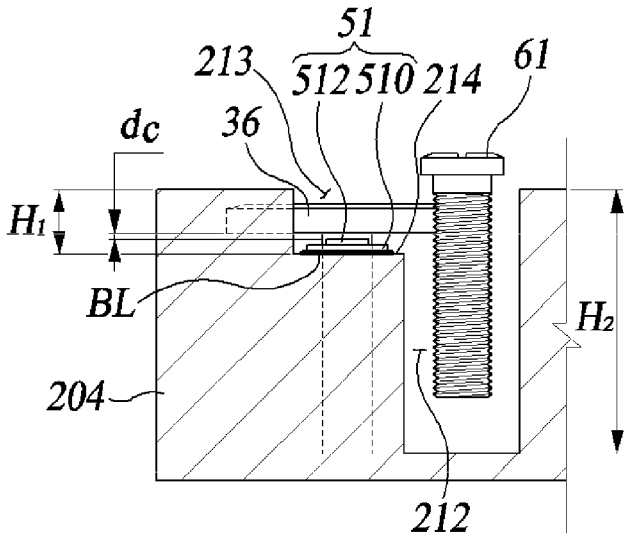
FIG. 3 is a cutaway view taken along line III-III' in FIG. 2.

FIG. 2 is a cross-sectional view of portion A of the radio frequency filter, indicated by a dotted rectangle in FIG. 1, showing the coupling substrate 51, the fourth resonance element 34, the sixth resonance element 36, the tuning screw 61, and the like in more detail. FIG. 3 is a cutaway view taken along line III-III' in FIG. 2. For understanding of the configuration, FIG. 2 shows a part of the coupling substrate 51 hidden by the resonance elements 34 and 36 with a dotted line, and FIG. 3 shows a part of the sixth resonance element 36 hidden by the partition wall 204 with a dotted line.

Figure 4:
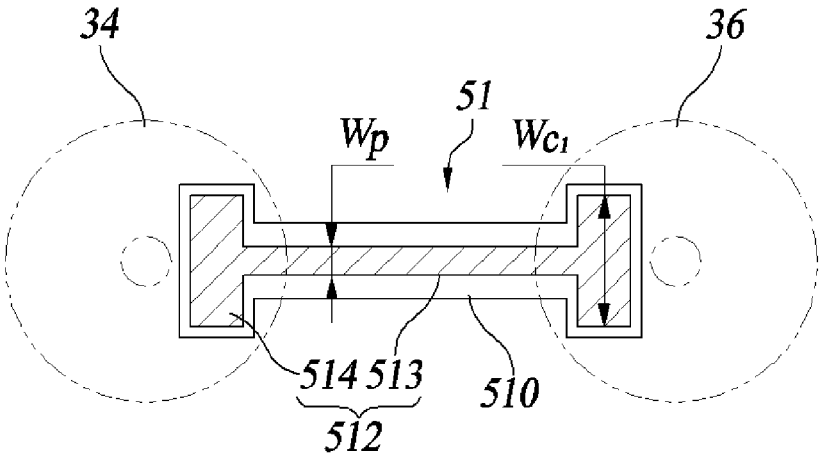
FIG. 4 is a top view of a coupling substrate.

FIG. 4 is a top view of the coupling substrate 51. For understanding of the configuration, the resonance elements 34 and 36 disposed on the coupling substrate 51 in an overlapping manner in FIG. 4 are indicated by two-dot chain lines.

Referring to FIGS. 2 to 4, in one embodiment of the present disclosure, the window structure formed in the partition wall 204 includes a support window 213 formed to have a first depth H1 from the top end of the partition wall 204, that is, the open surface on which the cover 20 is disposed, and a tuning window 212 formed to have a second depth H2 greater than the first depth H1 from the open surface. The coupling substrate 51 may be arranged through the support window 213 and disposed on a support step 214 of the partition wall, which forms a lower portion of the support window 213. In one embodiment, the support window 213 and the tuning window 212 may form a window structure having a "ㄱ" shape on the partition wall 204 together.

In one embodiment of the present disclosure, the coupling substrate 51 may be adhered to the support step 214 of the partition wall within the support window 213 by a bonding layer BL. In one embodiment, the bonding layer BL may be soldering.

In one embodiment of the present disclosure, the support window 213 may be formed by machining the partition wall 204 pre-formed in the housing. As is known, machining by grinding or polishing metals may guarantee very high dimensional accuracy, for example, dimensional accuracy in the order of a few microns.

The coupling substrate 51 may have a printed circuit board (PCB) structure as a whole. In some embodiments, the coupling substrate 51 may include, for example, a base substrate 510 made of a non-conductive material such as Teflon, and a conductive pattern layer 512 formed on at least one surface of the base substrate 510. The base substrate 510 may be implemented as a single-layer or multi-layer substrate of flame retardant (FR) series or composite epoxy material (CEM) series, similar to a typical PCB substrate.

The conductive pattern layer 512 may include two capacitive pads 514 disposed adjacent to the resonance discs of at least two resonance elements, that is, the fourth resonance element 34 and the sixth resonance element 36 in the example of FIGS. 2 to 4, and a connecting line portion 513 configured to connect the capacitive pads 514.

In one embodiment, the connecting line portion 513 may have a relatively narrow width Wp to reduce the effect of electrical coupling between surrounding structures, for example, the partition walls 204 or the tuning screws 61. The capacitive pads 514 may have a relatively wide width Wc1 to increase capacitive coupling with the resonance elements 34 and 36. That is, in one embodiment, the conductive pattern layer 512 and the base substrate 510 may have a dumbbell shape or an I shape.

The base substrate 510 of the coupling substrate 51 may be easily mass-produced with a constant thickness, and in particular, may be manufactured with a small thickness tolerance of several micrometers. In addition, the conductive pattern layer 512 formed on the base substrate 510 may also have a small tolerance by a printing process and may be formed to have a constant thickness.

In one embodiment, the opposite surface of the base substrate 510 of the coupling substrate 51 may contact the support step 214 of the partition wall 204. The base substrate 510, which is insulative, may provide insulation between the support step 214 of the partition wall 204 and the connecting line portion 513 of the conductive pattern layer 512. This configuration may be a difference from the conventional technology, which requires a separate insulating member surrounding the coupling notch and passing through the partition wall to be provided to maintain the insulation between the coupling notch passing through the partition wall and the partition wall.

Furthermore, in one embodiment, the coupling substrate 51, which may be formed to have a precise thickness without tolerance, may be disposed on the support step 214 in the support window 213, which may be formed by precision machining to have a precise first depth H1 without tolerance, and may be, for example, may be adhered thereto. Thus, the height of the conductive pattern layer 512 of the coupling substrate 51 on the support step 214 may also be precisely maintained without tolerance.

This configuration has a technical significance in that the distance between the bottom surface of the disc of the resonance element and the conductive pattern layer 512 of the coupling substrate 51 can be precisely maintained with a small tolerance in the radio frequency filter. As described above, as the radio frequency filter is miniaturized, the size of the notch structure is limited. In order to obtain an appropriate cross-coupling degree with the notch structure of a limited size, the resonance elements and the notch structure, for example, the coupling substrate 51, may need to be positioned very close to each other.

As the distance between two conductive members decreases, the capacitance between the two conductive members inverse-proportionally increases. However, in this case, the degree of manufacturing tolerance by which the distance between the two conductive members affects the magnitude of the capacitance will be greatly increased.

On the other hand, as described above, in one embodiment, the distance d between the capacitive pad 514 and the bottom surface of the disc of the resonance element may be precisely maintained with a small tolerance. Accordingly, according to the embodiment, by designing the distance dc between the capacitive pad 514 and the bottom surface of the resonance element to be very short, a small notch structure having a high coupling degree may be provided.

In one embodiment, although the coupling substrate 51 and the resonance element may maintain the distance therebetween with a small tolerance, the magnitude of the capacitance between the coupling substrate 51 and the resonance elements may undergo tolerance variation despite a small distance tolerance as the distance is very short.

In connection with this characteristic, the present disclosure provides a notch tuning structure capable of fine-tuning an attenuation pole. In one embodiment, the notch tuning structure for fine tuning may be configured with a tuning window 212 and a tuning screw 61 inserted into the tuning window 212.

The tuning window 212 is formed at a second depth H2 that is deeper than the first depth H1 from the open surface. For example, after the partition wall 204 is machined to remove an upper portion of the partition wall to form the first depth H1, a portion of the machined area of the partition wall 204 may be further machined to form the support window 213 having the first depth H1 and the tuning window 212 having the second depth H2. Thereby, the tuning window 212 and the support window 213 will form a window structure having a "ㄱ" shape on the partition wall 204 together.

As shown in FIG. 3, the tuning window 212 may be formed to have a depth close to the bottom surface of the housing 20. The tuning screw 61 may be inserted into the tuning window 212 of the partition wall 204. In one embodiment, the radio frequency filter may be configured to increase inductance between the two resonance elements 34 and 36 as the depth by which the tuning screw 61 is inserted into the tuning window 212 increases. This may be because the tuning screw 61 is electrically connected to the upper cover and serves as a medium to promote mutual inductance between the two resonance elements 34 and 36.

In one embodiment, the tuning window 212 may be formed significantly deeper than the support window 213, that is, as to have the second depth H2. Accordingly, the depth of the tuning screw 61 that may be inserted into the tuning window may be correspondingly adjusted to be considerably deep or to be very shallow as needed. In one embodiment, since the degree of insertion of the tuning screw 61 may be adjusted to be large, the variation range of the inductance required to be adjusted between the two resonance elements may be widened, and the variation in inductance between the resonance elements 34 and 36, which is adjusted by turning the tuning screw 61, may be fine-tuned.

The increase in the degree of flexible coupling, i.e., inductance, between the two resonance elements 34 and 36, i.e., may be interpreted as reducing the degree of effective capacitive coupling, i.e., effective capacitance, between the two resonance elements 34 and 36.

As described above, in one embodiment, by arranging the coupling substrate 51 and the conductive pattern layer 512 very close to each other with a small tolerance, a notch structure having a large capacitive coupling structure may be formed, and thus a flexible coupling structure having a wide inductance adjustment range and capable of fine tuning, that is, the structure of the tuning window 212 of the second depth H2 and the tuning screw may be complementarily provided. As a result, a radio frequency filter having a notch structure capable of smooth transmission zero adjustment while having an appropriate degree of capacitive coupling may be provided despite miniaturization of the radio frequency filter.

Figure 5:
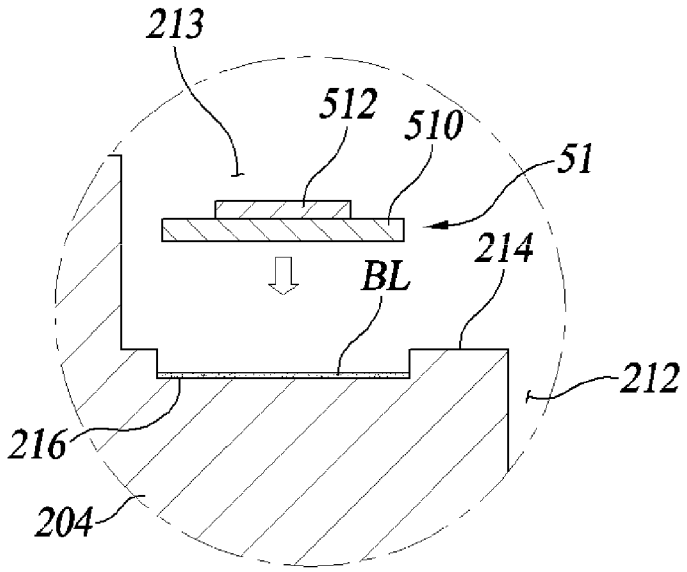
FIG. 5 is a partial cross-sectional view showing a support structure of a coupling substrate according to another embodiment of the present disclosure.
Figure 6:
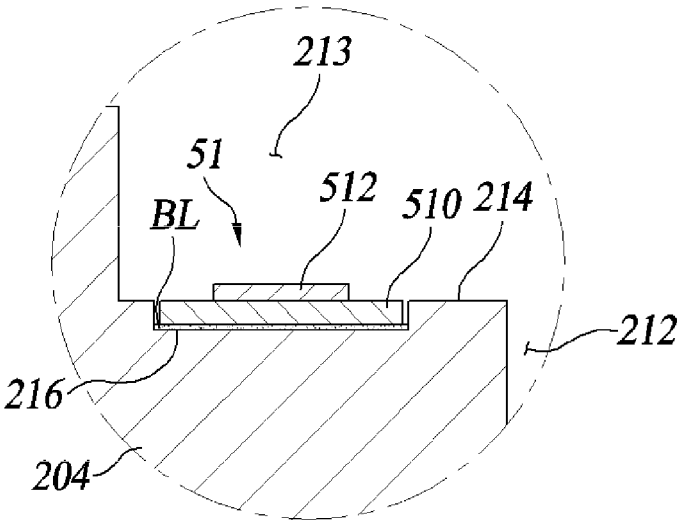
FIG. 6 is a partial cross-sectional view illustrating arrangement of a coupling substrate on the coupling support structure according to another embodiment of the present disclosure.

FIG. 5 is a partial cross-sectional view showing a support structure of the coupling substrate 51 according to another embodiment of the present disclosure. FIG. 6 is a partial cross-sectional view illustrating arrangement of the coupling substrate 51 on the support structure of the coupling substrate 51 according to another embodiment of the present disclosure.

Referring to FIGS. 5 and 6, in another embodiment of the present disclosure, the partition wall 204 may further include a seating groove 216 formed on the support step 214. The seating groove 216 may have a width corresponding to the width of the coupling substrate 51, in particular, the connecting line portion 513. The seating groove 216 may extend perpendicular to the partition wall 204, that is, in a direction parallel to a straight line connecting the two resonance elements. At least a portion of the coupling substrate 51 may be disposed in the seating groove 216 and, for example, bonded by a bonding layer BL. As a result, the coupling substrate 51 may be aligned at a predetermined position with a direction parallel to the straight line connecting the two resonance elements without a separate alignment process.

Figure 7:
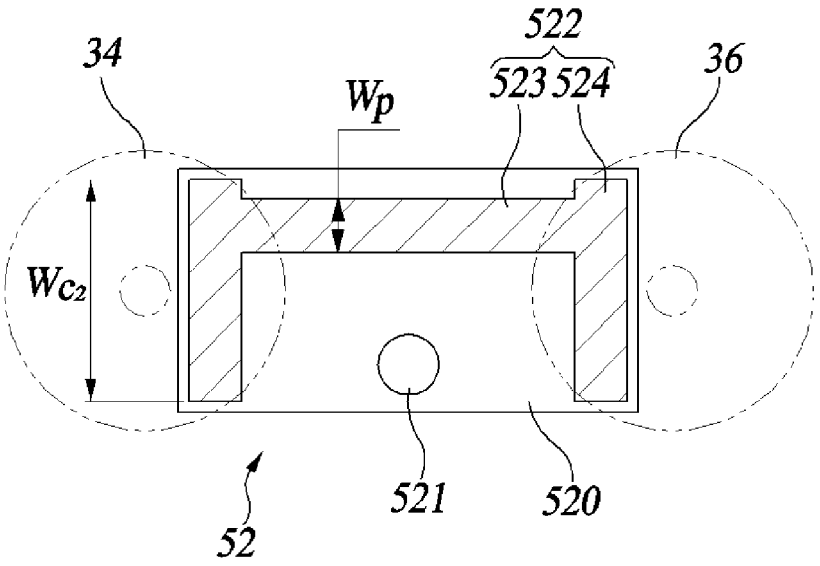
FIG. 7 is a top view of a quadrangular coupling substrate of a radio frequency filter according to yet another embodiment of the present disclosure.
Figure 8:
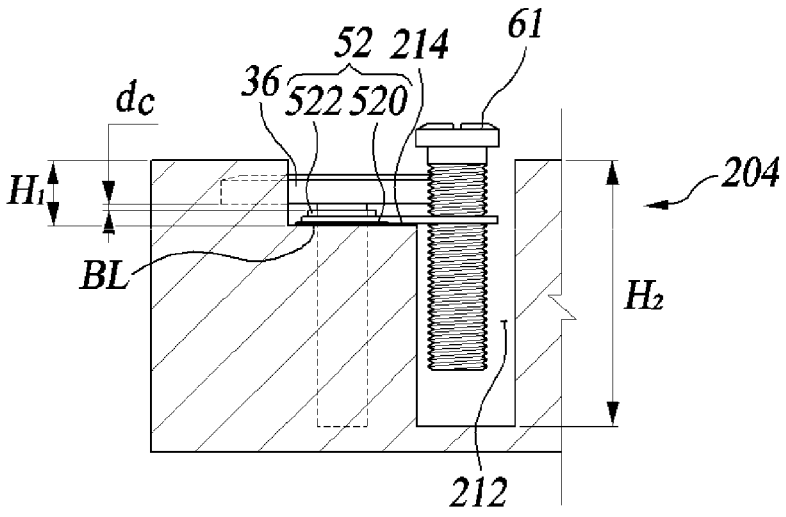
FIG. 8 is a partial cross-sectional view illustrating a state in which the quadrangular coupling substrate of the radio frequency filter according to the embodiment shown in FIG. 7 is supported on a partition wall.

FIG. 7 is a top view of a quadrangular coupling substrate 52 of a radio frequency filter according to yet another embodiment of the present disclosure. For understanding of the configuration, in FIG. 7, the resonance elements 34 and 36 overlapping the quadrangular coupling substrate 52 are indicated by two-dot chain lines. FIG. 8 is a partial cross-sectional view illustrating a state in which the quadrangular coupling substrate 52 of the radio frequency filter according to the embodiment shown in FIG. 7 is supported on a partition wall.

Referring to FIGS. 7 and 8, the illustrated embodiment of the present disclosure is different from the embodiment described with reference to FIGS. 1 to 4 in that the coupling substrate 52 includes a quadrangular base substrate 520. Hereinafter, the difference of the illustrated embodiment of the present disclosure will be mainly described, and descriptions of components substantially the same as those of the previous embodiment of the present disclosure will be omitted.

The rectangular coupling substrate 52 includes a quadrangular, e.g., rectangular, base substrate 520. A conductive pattern layer 522 is formed on the base substrate 520 and may include a connecting line portion 523 positioned on one side of the center of the base substrate 520 and a capacitive pad 524 connected to both ends of the connecting line portion 523. The base substrate 520 may include a screw through hole 521 located on an opposite side of the center thereof. The depth of the tuning screw 61 may be adjusted within the tuning window 212 through the screw through hole 521.

In this embodiment, since the base substrate 520 of the quadrangular coupling has a quadrangular shape, it may be fabricate by simply cutting a PCB. In addition, the capacitive pad 524 may be formed to have a second width Wc2 corresponding to the increased width of the base substrate 520, and accordingly the capacitance between the resonance elements 34 and 36 and the capacitive pad may be further increased.

Figure 9:
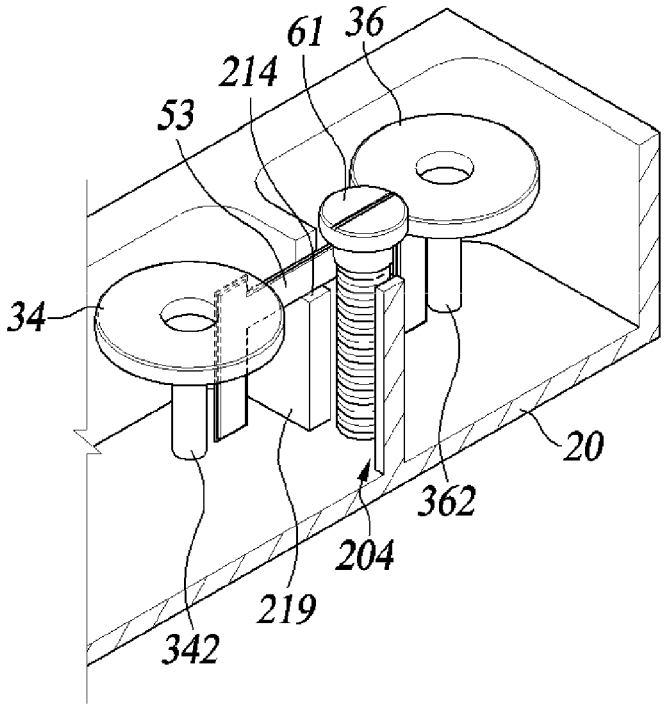
FIG. 9 is a partially cutaway perspective view of a radio frequency filter according to yet another embodiment of the present disclosure.
Figure 10:
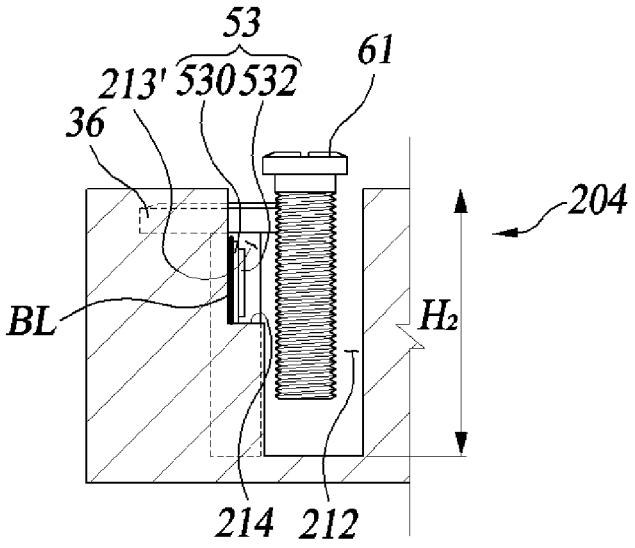
FIG. 10 is a partial cross-sectional view of the embodiment shown in FIG. 9.
Figure 11:
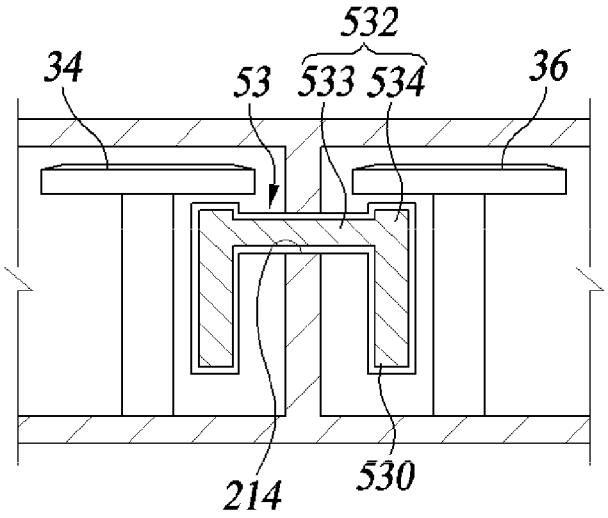
FIG. 11 is a partial longitudinal sectional view of the embodiment shown in FIG. 9.

FIG. 9 is a partially cutaway perspective view of a radio frequency filter according to yet another embodiment of the present disclosure. FIG. 10 is a partial cross-sectional view of the embodiment shown in FIG. 9. FIG. 11 is a partial longitudinal sectional view of the embodiment shown in FIG. 9.

Referring to FIGS. 9 to 11, this embodiment of the present disclosure is difference from the embodiment of the present disclosure described with reference to FIGS. 1 to 4 in that the coupling substrate 53 is vertically disposed on the support step 214 of the partition wall 204 in the height direction of the housing. Hereinafter, the difference of this embodiment of the present disclosure will be mainly described, and descriptions of components substantially the same as those of the previous embodiment of the present disclosure will be omitted.

In the illustrated embodiment, the coupling substrate 53 may include an H-shaped conductive pattern layer 532 and a base substrate 530 having a corresponding shape. The coupling substrate 53 may be vertically disposed along the height direction of the housing on the support step 214 of the partition wall 204, and the capacitive pad of the conductive pattern layer 532 may be arranged adjacent and parallel to resonance rods 342 and 362 of the resonance elements 34 and 36. In this embodiment, the conductive pattern layer 532 may be capacitive-coupled to the resonance rods 342,362. The base substrate 530 may be bonded (BL) to one side wall of the partition wall that forms one side of a support window 213' while erected on the support step 214.

In this embodiment, the coupling substrate 53 is disposed upright, and thus the size of the support window 213' may be reduced. This configuration may provide an advantage in terms of securing space when the radio frequency filter is additional miniaturized.

The above description is merely illustrative of the technical idea of the present embodiment, and those skilled in the art to which this embodiment belongs will appreciate that various modifications and variations are possible without departing from the essential characteristics of the embodiments. Therefore, the present embodiments are not intended to limit the technical spirit of the present disclosure, and the scope of the technical spirit of the present disclosure is not limited by these embodiments. The scope of protection sought for by the present disclosure should be interpreted by the claims below, and all technical spirits within the scope equivalent thereto should be interpreted as being included in the scope of rights of the present disclosure.

MODE FOR INVENTION

Hereinafter, some embodiments of the present disclosure will be described in detail with reference to the accompanying drawings. It should be noted that, in adding reference numerals to the constituent elements in the respective drawings, like reference numerals designate like elements, although the elements are shown in different drawings. Further, in the following description of the present disclosure, a detailed description of related known elements and functions incorporated herein may be omitted to avoid obscuring the subject matter of the present disclosure.

Hereinafter, embodiments according to the present disclosure will be described in detail with reference to the accompanying drawings.

FIG. 1 is an exploded perspective view of a cavity-type radio frequency filter according to an embodiment of the present disclosure.

Referring to FIG. 1, a cavity-type radio frequency filter according to an embodiment of the present disclosure includes a hollow housing 20, a cover 10, a plurality of resonance elements 31 to 37, a coupling substrate 51, and a tuning screw 61.

In one embodiment, the cavity-type radio frequency filter is provided with an enclosure formed hollow inside and having multiple cavities (for example, 7 cavities as in FIG. 1) blocked from the outside. In one embodiment, the enclosure includes a housing 20 provided with, for example, seven cavities and having one side (e.g., an upper side) open, and a cover 10 arranged to shield the open surface of the housing 20. The cover 10 and the housing 20 may be joined to each other by laser welding or soldering, or may be coupled to each other by screw coupling using a fixing screw (not shown).

The housing 20 and the cover 10 may be made of a metallic material such as, for example, aluminum or an alloy thereof, and may be plated with silver or copper on at least a surface forming a cavity to improve electrical properties. The resonance elements may also be made of a material such as aluminum (alloy) or iron (alloy), and may be plated with silver or copper.

In the embodiment shown in FIG. 1, for example, seven cavity structures are illustrated as being connected in multiple stages in the housing 20. That is, seven cavity structures may be sequentially connected. Each cavity of the housing 20 is provided with a resonance element 31, 32, 33, 34, 35, 36, 37 in the center thereof. In addition, in order to ensure that the respective cavity structures in the housing 20 have sequential coupling to each other, a coupling window, which is a connection passage structure, is formed between the cavity structures sequentially connected to each other. The coupling window may be formed by removing a predetermined portion of a predetermined size from a portion corresponding to partition walls 201, 202, 203, 204, and 205 of the cavity structures.

In the structure shown in FIG. 1, at least a part of the resonance elements 31, 32, 33, 34, 34, 35, 36, 37 may have the same structure. However, in the embodiment illustrated in FIG. 1, for convenience of description, all the resonance elements are illustrated as having the same structure. For example, each of the first to seventh resonance elements 31 to 37 may include a flat plate portion having a circular disc shape, and a support for fixing and supporting the flat plate portion. Each support is fixedly installed on the inner bottom surface of the corresponding cavity, that is, the housing 20. More specifically, the flat plate portion and the support in each of the resonance elements 31 to 37 may have various structures according to the design conditions of the corresponding filter, and resonance elements of different detailed structures may be configured to be mixed.

First to seventh recessed structures 101, 102, 103, 104, 105, 106, and 107 for frequency tuning may be formed in the cover 10 to correspond to the resonance elements 31 to 37 of the respective cavity structures. In addition, multiple coupling tuning screw holes 111 may be formed in the cover 10 at positions corresponding to the coupling windows which are connection passage structures of the cavity structures in the housing 20. Coupling tuning screws 41 for coupling tuning are inserted into the coupling tuning screw holes 111 at an appropriate depth to perform a coupling tuning operation. Here, the coupling tuning screws 41 may be additionally fixed using a separate adhesive such as epoxy resin.

In addition, an input terminal 21 and an output terminal 22 of the radio frequency filter may be installed through a through hole or the like that may be formed on one side of the housing 20. In the example of FIG. 1, it is illustrated that the input terminal 21 is coupled to the first resonance element 31, and the output terminal 22 is connected to the seventh resonance element 37. For example, an extension line (not shown) of the input terminal 21 and the support of the first resonance element 31 may be coupled in a manner of direct connection, or may be connected in a non-contact coupling manner.

In the configuration above, the structure of the cover 10 may have a structure similar to that applied to a radio frequency filter having a conventional cavity structure. For example, the cover 10 may have a structure similar to the structure disclosed in Korean Patent Application Publication No. 10-2014-0026235 (entitled "RADIO FREQUENCY FILTER WITH CAVITY STRUCTURE"; Publication Date: Mar. 5, 2014; Inventor: PARK Namshin et al.) filed by the present applicant. Korean Patent Application Publication No. 10-2014-0026235 proposes a simplified filter structure capable of frequency tuning without employing a more general fastening structure of a tuning screw and a fixing nut. The cover 10 according to embodiments of the present disclosure has one or more recessed structures 102 to 107 formed at positions corresponding to the resonance elements 31 to 37. Multiple dot peen structures are formed in the recessed structures 102 to 107 by marking or pressing by a marking pin of external marking equipment to enable frequency tuning.

In some other embodiments of the present disclosure, a more generalized frequency tuning method may be applied to the cover 10, and thus a frequency tuning screw and a fixing nut may be provided without forming a structure such as the recessed structure 12. However, the structure provided with the frequency tuning screw and the fixing nut may be more complex and may be difficult to miniaturize.

Regarding the above-described structures, the cavity structures formed in the housing 20 and the cover 10 in the radio frequency filter according to an embodiment of the present disclosure, and the structures of the resonance elements 31 to 37 inside the cavities are similar to a conventional structure except that the structure may be implemented in a smaller size than the conventional structure. However, the cross-coupling structure capable of fine tuning according to embodiments of the present disclosure may have an improved structure compared to the conventional structure.

In one embodiment, the coupling substrate 51 is arranged to cross the partition wall 204 between at least two resonance elements. In the embodiment, it is illustrated that the coupling substrate 51 is arranged to cross the partition wall 204 between the fourth resonance element 34 and the sixth resonance element 36.

Here, the coupling substrate 51 is installed on the partition wall 204 that separates the cavity of the fourth resonance element 34 from the cavity of the sixth resonance element 36, and is provided with a window structure formed by removing an appropriate portion such that the tuning screw 61 may be disposed therein.

In addition, the cover 10 is provided with a notch tuning through hole 121 at a position corresponding to the coupling substrate 51. The tuning screw 61 is coupled to the notch tuning through hole to tune the notch characteristic. The tuning screw 61 set to an appropriate length for notching tuning is inserted into the notch tuning through hole 121 to tune the notch characteristic in connection with the coupling substrate 51. Here, the tuning screw 61 may be formed in a screw shape as a whole, and may have a structure coupled to the notching tuning through hole 121 in a screw coupling manner. The tuning screw 61 may be formed of a conductive metal material such as aluminum (alloy) or brass (alloy), and plated with silver.

FIG. 2 is a cross-sectional view of portion A of the radio frequency filter, indicated by a dotted rectangle in FIG. 1, showing the coupling substrate 51, the fourth resonance element 34, the sixth resonance element 36, the tuning screw 61, and the like in more detail. FIG. 3 is a cutaway view taken along line III-III' in FIG. 2. For understanding of the configuration, FIG. 2 shows a part of the coupling substrate 51 hidden by the resonance elements 34 and 36 with a dotted line, and FIG. 3 shows a part of the sixth resonance element 36 hidden by the partition wall 204 with a dotted line.

FIG. 4 is a top view of the coupling substrate 51. For understanding of the configuration, the resonance elements 34 and 36 disposed on the coupling substrate 51 in an overlapping manner in FIG. 4 are indicated by two-dot chain lines.

Referring to FIGS. 2 to 4, in one embodiment of the present disclosure, the window structure formed in the partition wall 204 includes a support window 213 formed to have a first depth H1 from the top end of the partition wall 204, that is, the open surface on which the cover 20 is disposed, and a tuning window 212 formed to have a second depth H2 greater than the first depth H1 from the open surface. The coupling substrate 51 may be arranged through the support window 213 and disposed on a support step 214 of the partition wall, which forms a lower portion of the support window 213. In one embodiment, the support window 213 and the tuning window 212 may form a window structure having a "¬" shape on the partition wall 204 together.

In one embodiment of the present disclosure, the coupling substrate 51 may be adhered to the support step 214 of the partition wall within the support window 213 by a bonding layer BL. In one embodiment, the bonding layer BL may be soldering.

In one embodiment of the present disclosure, the support window 213 may be formed by machining the partition wall 204 pre-formed in the housing. As is known, machining by grinding or polishing metals may guarantee very high dimensional accuracy, for example, dimensional accuracy in the order of a few microns.

The coupling substrate 51 may have a printed circuit board (PCB) structure as a whole. In some embodiments, the coupling substrate 51 may include, for example, a base substrate 510 made of a non-conductive material such as Teflon, and a conductive pattern layer 512 formed on at least one surface of the base substrate 510. The base substrate 510 may be implemented as a single-layer or multi-layer substrate of flame retardant (FR) series or composite epoxy material (CEM) series, similar to a typical PCB substrate.

The conductive pattern layer 512 may include two capacitive pads 514 disposed adjacent to the resonance discs of at least two resonance elements, that is, the fourth resonance element 34 and the sixth resonance element 36 in the example of FIGS. 2 to 4, and a connecting line portion 513 configured to connect the capacitive pads 514.

In one embodiment, the connecting line portion 513 may have a relatively narrow width Wp to reduce the effect of electrical coupling between surrounding structures, for example, the partition walls 204 or the tuning screws 61. The capacitive pads 514 may have a relatively wide width Wc1 to increase capacitive coupling with the resonance elements 34 and 36. That is, in one embodiment, the conductive pattern layer 512 and the base substrate 510 may have a dumbbell shape or an I shape.

The base substrate 510 of the coupling substrate 51 may be easily mass-produced with a constant thickness, and in particular, may be manufactured with a small thickness tolerance of several micrometers. In addition, the conductive pattern layer 512 formed on the base substrate 510 may also have a small tolerance by a printing process and may be formed to have a constant thickness.

In one embodiment, the opposite surface of the base substrate 510 of the coupling substrate 51 may contact the support step 214 of the partition wall 204. The base substrate 510, which is insulative, may provide insulation between the support step 214 of the partition wall 204 and the connecting line portion 513 of the conductive pattern layer 512. This configuration may be a difference from the conventional technology, which requires a separate insulating member surrounding the coupling notch and passing through the partition wall to be provided to maintain the insulation between the coupling notch passing through the partition wall and the partition wall.

Furthermore, in one embodiment, the coupling substrate 51, which may be formed to have a precise thickness without tolerance, may be disposed on the support step 214 in the support window 213, which may be formed by precision machining to have a precise first depth H1 without tolerance, and may be, for example, may be adhered thereto. Thus, the height of the conductive pattern layer 512 of the coupling substrate 51 on the support step 214 may also be precisely maintained without tolerance.

This configuration has a technical significance in that the distance between the bottom surface of the disc of the resonance element and the conductive pattern layer 512 of the coupling substrate 51 can be precisely maintained with a small tolerance in the radio frequency filter. As described above, as the radio frequency filter is miniaturized, the size of the notch structure is limited. In order to obtain an appropriate cross-coupling degree with the notch structure of a limited size, the resonance elements and the notch structure, for example, the coupling substrate 51, may need to be positioned very close to each other.

As the distance between two conductive members decreases, the capacitance between the two conductive members inverse-proportionally increases. However, in this case, the degree of manufacturing tolerance by which the distance between the two conductive members affects the magnitude of the capacitance will be greatly increased.

On the other hand, as described above, in one embodiment, the distance d between the capacitive pad 514 and the bottom surface of the disc of the resonance element may be precisely maintained with a small tolerance. Accordingly, according to the embodiment, by designing the distance dc between the capacitive pad 514 and the bottom surface of the resonance element to be very short, a small notch structure having a high coupling degree may be provided.

In one embodiment, although the coupling substrate 51 and the resonance element may maintain the distance therebetween with a small tolerance, the magnitude of the capacitance between the coupling substrate 51 and the resonance elements may undergo tolerance variation despite a small distance tolerance as the distance is very short.

In connection with this characteristic, the present disclosure provides a notch tuning structure capable of fine-tuning an attenuation pole. In one embodiment, the notch tuning structure for fine tuning may be configured with a tuning window 212 and a tuning screw 61 inserted into the tuning window 212.

The tuning window 212 is formed at a second depth H2 that is deeper than the first depth H1 from the open surface. For example, after the partition wall 204 is machined to remove an upper portion of the partition wall to form the first depth H1, a portion of the machined area of the partition wall 204 may be further machined to form the support window 213 having the first depth H1 and the tuning window 212 having the second depth H2. Thereby, the tuning window 212 and the support window 213 will form a window structure having a "¬" shape on the partition wall 204 together.

As shown in FIG. 3, the tuning window 212 may be formed to have a depth close to the bottom surface of the housing 20. The tuning screw 61 may be inserted into the tuning window 212 of the partition wall 204. In one embodiment, the radio frequency filter may be configured to increase inductance between the two resonance elements 34 and 36 as the depth by which the tuning screw 61 is inserted into the tuning window 212 increases. This may be because the tuning screw 61 is electrically connected to the upper cover and serves as a medium to promote mutual inductance between the two resonance elements 34 and 36.

In one embodiment, the tuning window 212 may be formed significantly deeper than the support window 213, that is, as to have the second depth H2. Accordingly, the depth of the tuning screw 61 that may be inserted into the tuning window may be correspondingly adjusted to be considerably deep or to be very shallow as needed. In one embodiment, since the degree of insertion of the tuning screw 61 may be adjusted to be large, the variation range of the inductance required to be adjusted between the two resonance elements may be widened, and the variation in inductance between the resonance elements 34 and 36, which is adjusted by turning the tuning screw 61, may be fine-tuned.

The increase in the degree of flexible coupling, i.e., inductance, between the two resonance elements 34 and 36, i.e., may be interpreted as reducing the degree of effective capacitive coupling, i.e., effective capacitance, between the two resonance elements 34 and 36.

As described above, in one embodiment, by arranging the coupling substrate 51 and the conductive pattern layer 512 very close to each other with a small tolerance, a notch structure having a large capacitive coupling structure may be formed, and thus a flexible coupling structure having a wide inductance adjustment range and capable of fine tuning, that is, the structure of the tuning window 212 of the second depth H2 and the tuning screw may be complementarily provided. As a result, a radio frequency filter having a notch structure capable of smooth transmission zero adjustment while having an appropriate degree of capacitive coupling may be provided despite miniaturization of the radio frequency filter.

FIG. 5 is a partial cross-sectional view showing a support structure of the coupling substrate 51 according to another embodiment of the present disclosure. FIG. 6 is a partial cross-sectional view illustrating arrangement of the coupling substrate 51 on the support structure of the coupling substrate 51 according to another embodiment of the present disclosure.

Referring to FIGS. 5 and 6, in another embodiment of the present disclosure, the partition wall 204 may further include a seating groove 216 formed on the support step 214. The seating groove 216 may have a width corresponding to the width of the coupling substrate 51, in particular, the connecting line portion 513. The seating groove 216 may extend perpendicular to the partition wall 204, that is, in a direction parallel to a straight line connecting the two resonance elements. At least a portion of the coupling substrate 51 may be disposed in the seating groove 216 and, for example, bonded by a bonding layer BL. As a result, the coupling substrate 51 may be aligned at a predetermined position with a direction parallel to the straight line connecting the two resonance elements without a separate alignment process.

FIG. 7 is a top view of a quadrangular coupling substrate 52 of a radio frequency filter according to yet another embodiment of the present disclosure. For understanding of the configuration, in FIG. 7, the resonance elements 34 and 36 overlapping the quadrangular coupling substrate 52 are indicated by two-dot chain lines. FIG. 8 is a partial cross-sectional view illustrating a state in which the quadrangular coupling substrate 52 of the radio frequency filter according to the embodiment shown in FIG. 7 is supported on a partition wall.

Referring to FIGS. 7 and 8, the illustrated embodiment of the present disclosure is different from the embodiment described with reference to FIGS. 1 to 4 in that the coupling substrate 52 includes a quadrangular base substrate 520. Hereinafter, the difference of the illustrated embodiment of the present disclosure will be mainly described, and descriptions of components substantially the same as those of the previous embodiment of the present disclosure will be omitted.

The rectangular coupling substrate 52 includes a quadrangular, e.g., rectangular, base substrate 520. A conductive pattern layer 522 is formed on the base substrate 520 and may include a connecting line portion 523 positioned on one side of the center of the base substrate 520 and a capacitive pad 524 connected to both ends of the connecting line portion 523. The base substrate 520 may include a screw through hole 521 located on an opposite side of the center thereof. The depth of the tuning screw 61 may be adjusted within the tuning window 212 through the screw through hole 521.

In this embodiment, since the base substrate 520 of the quadrangular coupling has a quadrangular shape, it may be fabricate by simply cutting a PCB. In addition, the capacitive pad 524 may be formed to have a second width Wc2 corresponding to the increased width of the base substrate 520, and accordingly the capacitance between the resonance elements 34 and 36 and the capacitive pad may be further increased.

FIG. 9 is a partially cutaway perspective view of a radio frequency filter according to yet another embodiment of the present disclosure. FIG. 10 is a partial cross-sectional view of the embodiment shown in FIG. 9. FIG. 11 is a partial longitudinal sectional view of the embodiment shown in FIG. 9.

Referring to FIGS. 9 to 11, this embodiment of the present disclosure is difference from the embodiment of the present disclosure described with reference to FIGS. 1 to 4 in that the coupling substrate 53 is vertically disposed on the support step 214 of the partition wall 204 in the height direction of the housing. Hereinafter, the difference of this embodiment of the present disclosure will be mainly described, and descriptions of components substantially the same as those of the previous embodiment of the present disclosure will be omitted.

In the illustrated embodiment, the coupling substrate 53 may include an H-shaped conductive pattern layer 532 and a base substrate 530 having a corresponding shape. The coupling substrate 53 may be vertically disposed along the height direction of the housing on the support step 214 of the partition wall 204, and the capacitive pad of the conductive pattern layer 532 may be arranged adjacent and parallel to resonance rods 342 and 362 of the resonance elements 34 and 36. In this embodiment, the conductive pattern layer 532 may be capacitive-coupled to the resonance rods 342,362. The base substrate 530 may be bonded (BL) to one side wall of the partition wall that forms one side of a support window 213' while erected on the support step 214.

In this embodiment, the coupling substrate 53 is disposed upright, and thus the size of the support window 213' may be reduced. This configuration may provide an advantage in terms of securing space when the radio frequency filter is additional miniaturized.

The above description is merely illustrative of the technical idea of the present embodiment, and those skilled in the art to which this embodiment belongs will appreciate that various modifications and variations are possible without departing from the essential characteristics of the embodiments. Therefore, the present embodiments are not intended to limit the technical spirit of the present disclosure, and the scope of the technical spirit of the present disclosure is not limited by these embodiments. The scope of protection sought for by the present disclosure should be interpreted by the claims below, and all technical spirits within the scope equivalent thereto should be interpreted as being included in the scope of rights of the present disclosure.

The invention claimed is:

1. A radio frequency filter comprising:

a hollow housing having a plurality of partition walls defining a plurality of cavities and an open surface formed on one side;

a cover configured to shield the open surface of the housing;

a plurality of resonance elements positioned in the cavities of the housing;

a coupling substrate arranged to cross a partition wall of the plurality of partition walls between at least two of the plurality of resonance elements; and a tuning screw inserted into the housing through the cover, wherein the partition wall crossed by the coupling substrate comprises:

a support window formed to have a first depth from the open surface, the coupling substrate being arranged through the support window; and a tuning window formed to have a second depth greater than the first depth from the open surface, the tuning screw being inserted into the tuning window, wherein the support window and the tuning window form a "¬"-shaped window structure on the partition wall crossed by the coupling substrate.

2. The radio frequency filter of claim 1, wherein, when a depth of insertion of the tuning screw into the tuning window increases, an inductance between at least two resonance elements of the plurality of resonance elements increases.

3. A radio frequency filter comprising:

a hollow housing having a plurality of partition walls defining a plurality of cavities and an open surface formed on one side;

a cover configured to shield the open surface of the housing;

a plurality of resonance elements positioned in the cavities of the housing;

a coupling substrate arranged to cross a partition wall between at least two of the plurality of resonance elements; and a tuning screw inserted into the housing through the cover, wherein the partition wall crossed by the coupling substrate comprises:

a support window formed to have a first depth from the open surface, the coupling substrate being arranged through the support window; and a tuning window formed to have a second depth greater than the first depth from the open surface, the tuning screw being inserted into the tuning window, wherein the coupling substrate comprises a base substrate and a conductive pattern layer formed on at least one surface of the base substrate, wherein the conductive pattern layer comprises:

a plurality of capacitive pads disposed adjacent to the at least two resonance elements; and a connecting line portion arranged to connect the capacitive pads.

4. The radio frequency filter of claim 3, wherein the base substrate has a rectangular shape, wherein the base substrate further comprises a screw through hole allowing the tuning screw to pass therethrough.

5. The radio frequency filter of claim 3, wherein at least one of the base substrate and the conductive pattern layer has a dumbbell shape.

6. The radio frequency filter of claim 3, wherein the coupling substrate is disposed in a height direction of the housing, wherein the capacitive pads are disposed side by side adjacent to resonance rods of the two resonance elements.

7. The radio frequency filter of claim 6, wherein an opposite surface of the base substrate is bonded to one side wall of the partition wall, the one side wall defining one side of the support window.

8. A radio frequency filter comprising:

a hollow housing having a plurality of partition walls defining a plurality of cavities and an open surface formed on one side;

a cover configured to shield the open surface of the housing;

a plurality of resonance elements positioned in the cavities of the housing;

a coupling substrate arranged to cross a partition wall between at least two of the plurality of resonance elements; and a tuning screw inserted into the housing through the cover, wherein the partition wall crossed by the coupling substrate comprises:

a support window formed to have a first depth from the open surface, the coupling substrate being arranged through the support window; and a tuning window formed to have a second depth greater than the first depth from the open surface, the tuning screw being inserted into the tuning window, wherein the support window is formed by removing a portion of the partition wall crossed by the coupling substrate, wherein the coupling substrate is disposed on a support step of a partition wall defining a lower portion of the support window.

9. The radio frequency filter of claim 8, further comprising:

a seating groove formed on the support step and extending parallel to a straight line connecting the at least two resonance elements, wherein at least a portion of the coupling substrate is disposed in the seating groove.

10. The radio frequency filter of claim 8, wherein the coupling substrate is bonded to the support step by soldering.

* * * * *